United States Patent [19]

McLeod

[11] Patent Number: 4,792,182

[45] Date of Patent: Dec. 20, 1988

[54] ADJUSTABLE FOLDING SAFETY CHAIR

[76] Inventor: Whitney G. McLeod, Gunther Islands, Eureka, Calif. 95501

[21] Appl. No.: 904,135

[22] Filed: Sep. 5, 1986

[51] Int. Cl.[4] ..... A47C 4/00

[52] U.S. Cl. ..... 297/55; 297/443

[58] Field of Search ..... 297/55, 443, 145

[56] References Cited

U.S. PATENT DOCUMENTS

| | | | |
|---|---|---|---|
| 1,342,650 | 6/1920 | Schlegel | 297/145 |
| 2,914,117 | 11/1959 | Underwood | 297/443 |
| 3,301,596 | 1/1967 | Eos | 297/443 |
| 4,077,668 | 3/1978 | Puccinelli | 297/443 |
| 4,239,280 | 12/1980 | Ackerman | 297/443 X |

FOREIGN PATENT DOCUMENTS

| | | | |
|---|---|---|---|
| 173291 | 12/1952 | Fed. Rep. of Germany | 297/443 |
| 876449 | 5/1953 | Fed. Rep. of Germany | 297/443 |
| 1460084 | 10/1966 | France | 297/443 |

*Primary Examiner*—Peter A. Aschenbrenner
*Attorney, Agent, or Firm*—Flehr, Hohbach, Test, Albritton & Herbert

[57] ABSTRACT

An adjustable folding slat type chair is disclosed which does not require a pivot pin, and folds flat and opens to a stable configuration.

5 Claims, 1 Drawing Sheet

θ MAX.
ω

ADJUSTABLE FOLDING SAFETY CHAIR

BACKGROUND OF THE INVENTION

The present invention relates to folding slat type chairs and more generally to X-shaped folding supports or cradles.

A number of folding X-configured chairs are available in the art. Conventionally, to my knowledge, the two legs of the X are attached to a screw or pivot pin for folding and unfolding and may include a stop mounted on one of the legs to establish the unfolded separation of the legs at a desired angle for sitting and to provide stability. Closely representative of such a design is U.S. Pat. No. 404,589 issued in the name of Batt, which discloses seat and back sections which are pivotally joined by a pin and a cross bar or stop which is joined to the bottom of the seat for defining the angle between the opened back and seat. U.S. Pat. No. 1,342,650 issued to Schlegel, also discloses a folding chair in which back and seat sections are commonly mounted on a pivot pin. In addition, a pair of cross bars or members are provided, one mounted to the rear of the back above the seat and the other mounted beneath the seat in front of the back (or leg) section, again apparently to define the angle between the opened back and seat.

To my knowledge, the screws or pins are used in prior art chairs to lock the seat and back sections together and to thus provide stability. The use of pivot pins however, fixes the position of the seat relative to the back and vice versa. Among other limitations, this prevents adjustment of the length of the seat or back during use and adjustment of the relative longitudinal position of the seat and back when folded.

SUMMARY OF THE INVENTION

In view of the above discussion, it is one object of my present invention to provide a generally X-configured folding support or chair in which the position of one of the two legs or longitudinal members can be adjusted by sliding that member through the other member.

A related object is to provide an X-configured folding chair in which the length of the seat can be adjusted by sliding the seat member through the back.

Another related object is to provide such an X-configured folding chair in which the recline of the chair can be varied by changing the length of the seat or the seat depth.

It is still another object of my present invention to provide such a generally X-configured folding chair in which the two members can be folded substantially flat and precisely aligned lengthwise to provide a compact storage configuration.

In one aspect, my present invention is embodied in a generally X-configured folding support or chair in which one of the two legs or longitudinal members comprises an assembly of transversely spaced longitudinal slats which are mounted for sliding movement within a transverse group of spaces or slots formed in the second longitudinal member. The second longitudinal member includes two cross bars mounted respectively on the back and front thereof above and below the first member. These cross bars or stops permit adjustable sliding movement of the first longitudinal member within the second member.

To illustrate the function of the above described structure consider, for example, the embodiment of an X-configured chair. The described structure provides safe, stable seating in that the seat and back members can be folded open to a set position of fixed angular separation which is determined by the position of the seat member within the back member and by the position and spacing of the cross members or stops. That is, the cross members establish the maximum angular separation while sliding the seat member within the back member varies the maximum angular separation. Specifically, a shorter seat depth or length provides a smaller angle of recline between the seat and back whereas a larger seat depth or length provides a larger angle of recline. In addition, the seat and back can be folded flat and aligned precisely lengthwise to provide very compact storage. It should be noted that the seat and back members define supporting legs beneath the intersection.

My above described invention applies in general to X-configured supports. For example, the term "X-configured" is generic to other configurations such as for example, one in which one of the longitudinal members is longer than the other. Also, my present invention applies to supports in general, including, but not limited to chairs.

BRIEF DESCRIPTION OF THE DRAWINGS

The above and other aspects of my present invention are described with respect to the drawings in which.

DETAILED DESCRIPTION

Figures 1, 2, 3, 4, 5:
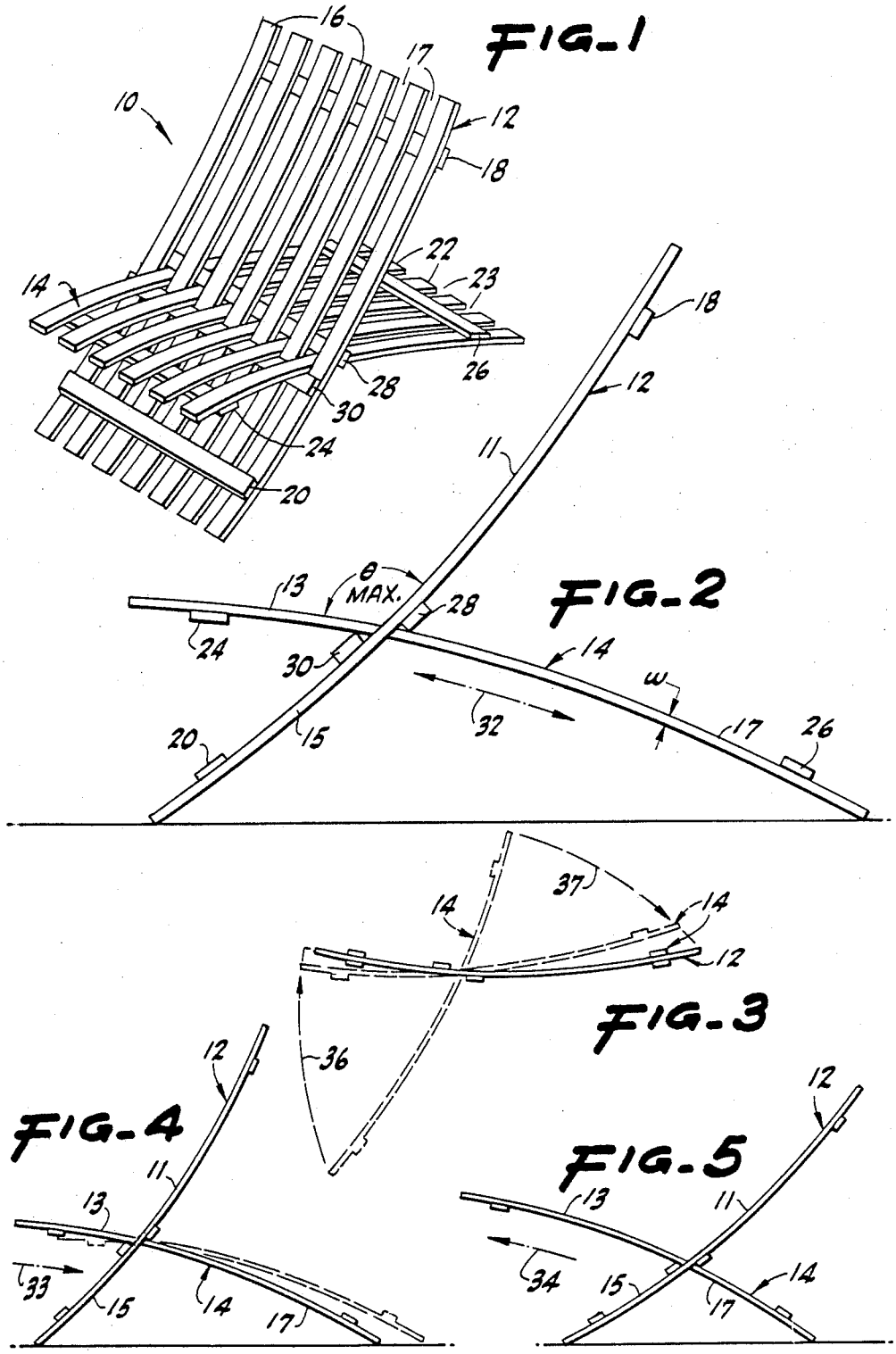
FIG. 1 is a perspective view of a preferred embodiment of a slat or stave chair which incorporates my present invention.
FIG. 2 is a side sectional view of the chair of FIG. 1.
FIG. 3 schematically illustrates the chair of FIG. 1 folded into a storage position with the two longitudinal members precisely aligned lengthwise.
FIGS. 4 and 5 both depict the chair of FIG. 2 with the seat retracted and extended, respectively.

FIG. 1 is a perspective view of a preferred embodiment of my X-shaped folding slat chair 10. The chair comprises a backrest-forming and leg-forming longitudinal section 12 and an intersecting seat-forming and leg-forming longitudinal section 14. The back-forming generally upright section 12 is formed of a number of spaced longitudinal slats 16. The slats 16 are mounted to an upper transverse support bar 18 and a lower transverse support bar or sill 20 which maintain the desired spacing 17 between the slats 16. Similarly, the seat-forming section or member 14 comprises a number of longitudinal bars or slats 22 having space 23 between the adjacent slats. The slats 22 are mounted on a front transverse support bar 24 and a rear transverse support bar 26.

Referring also to FIG. 2, an upper locking bar 28 extends transversely across and is mounted to the rear side to the back section 12 just above the seat-forming section 14. A lower locking bar 30 extends across and is mounted to the front side of the back-forming section 12 just beneath the seat section 14. The back section 12 forms a back rest 11 as well as legs 15, while the seat section 14 forms the seat 13 as well as the legs 17.

The locking bars 28 and 30 are spaced apart at a sufficient distance to define a transverse array of apertures in the back member 12 so that the seat member 14 can be slidably adjusted bi-directionally through the back 12, as indicated by arrow 32. The spacing between the bars 28 and 30 is just slightly greater than the width w of the slats 22 to permit ease of sliding movement yet to firmly lock the back and seat at the maximum angle $\theta_{max}$ when the seat is unfolded.

That is, when the chair is pivoted open, as indicated by arrow 32 from the flat folded position shown in FIG. 3 to the open position shown in FIG. 2, the transverse bars or stops 28 and 30 respectively are moved into abutment against the top of the leg 17 and the bottom of the seat 13 of the longitudinal member 14. This limits pivotal opening to the angular separation $\theta_{max}$ shown in FIG. 2. The members 12 and 14 cannot be pivoted past the angular separation $\theta_{max}$. This maximum angle of separation can, however, be altered as desired by slightly altering the spacing between the transverse stops or cross bars 28 and 30. In addition, when a person or other weight is seated in the chair, frictional engagement between the stop 28 and the leg 17 and between the stop 30 and the seat 13 caused by that weight, prevents sliding movement of the seat member 14 within the back member 12.

The position of the longitudinal member 14 within the longitudinal member 12 is easily adjusted if a person is not seated in the chair by simply sliding the member 14 in the desired direction indicated by arrow 32, FIG. 2. Referring to FIG. 4, sliding member 14 to the right as indicated by arrow 33 shortens the length of the seat 13 and increases the length of legs 17, thereby decreasing the reclining angle of the back 12. That is, the back 12 is moved nearer to the vertical orientation thereby decreasing the angle of recline between the back rest 11 and the vertical.

Conversely, and referring to FIG. 5, sliding member 14 to the left as indicated by arrow 34 increases the length of the seat 13 and decreases the length of the leg 17. This increases the angle of recline.

FIG. 3 illustrates the fully folded position of the chair. Elimination of the use of a pivot pin and the use of the stops 28 and 30 not only permit the two longitudinal members 12 and 14 to be readily folded toward one another as indicated by arrows 36 and 37, flat against one another, but also allows these two members to be aligned lengthwise with minimum extension of one past the other. As a result, the folded chair is flat and the length approximates the length of the longer of the two members 12 and 14.

Those of usual skill in the art will readily appreciate that the above described X-configured structure 10 is applicable in general to adjustable, folding structures in addition to, but certainly not limited to, folding chairs. For example, the members 12 and 14 can be designed to intersect at the mid-point of member 12, thus providing an orientation in which the members 11 and 13 (and/or members 15 and 17) are of equal lengths and define equal angles with respect to the vertical. Such construction and configuration can be used, for example, in a cradle.

In the presently preferred embodiment of my chair 10, the slats 16 and 22 are barrel staves. This facilitates manufacture of the chair and provides an esthetically very pleasing appearance.

Thus, I have described preferred and alternative embodiments of my folding, X-configured folding structure which can be used for chairs, cradles and other support structures. The structure is esthetic as well as simple and features clean, simple lines. The construction and function of the transverse stops eliminate the need for pivot pins or rods and the associated hardware, provide a relatively simple structure which is easy to fabricate and assemble, provide adjustable seat depth and recline, provide a compact folded configuration and, perhaps most importantly, provide a stable, unfolded or open configuration.

The key features of the chair reside in the combination of the use of slats or staves to form the chair, the slidable X-configured construction; and the cross bars or stops attached respectively to the rear of the back above the seat and to the front of the legs beneath the seat to stably support the back on the rear legs and the seat on the front legs. The two cross bars permit the two longitudinal sections to be folded together for storage and to be unfolded for seating as indicated, and permit sliding adjustment of the length of the seat and the associated angle of recline, but at the same time preclude collapse or folding past the angle $\theta_{max}$, FIG. 2, and provide the stable unfolded configuration.

Having thus described preferred and alternative embodiments of my folding X-configured support structure including a preferred barrel stave chair embodiment thereof, I claim:

1. An adjustable folding safety support, comprising:

(a) a first longitudinal section having rear and front sides and first and second opposite ends and comprising longitudinally extending, spaced slats defining continuous spaces therebetween and further comprising first and second spaced supporting cross members located respectively proximate the first and second opposite ends, thereby defining an uninterrupted intermediate region of continuous slat spaces therebetween;

(b) a second longitudinal section having front and rear sides and comprising an intermediate transverse array of slots for receiving the spaced continuous slats of the first section for sliding movement of said first section along said uninterrupted continuous intermediate region thereof;

(c) the first section forming a seat between the first end thereof and the second section and forming a leg between the second end thereof and the second section for supporting the chair; and (d) first and second spaced transverse cross bars joined respectively to the rear and front of the second section on opposite sides of the transverse array of slots for slidably receiving the slats of the first section therebetween and thereby permitting pivotal movement of the first and second sections from a first folded position with the first and second sections closely adjacent and a second spaced position with the upper and lower cross bars of said section abutting the respective rear and front sides of the first section thereby preventing the first and second sections from being pivoted further apart;

(e) whereby sliding movement of said first section relative to said second section adjusts the length of the seat relative to the leg.

2. The adjustable folding safety support of claim 1, said second section comprising longitudinally extending transversely spaced legs or slats and said transverse array of slots being defined by the spacing between the second section slats.

3. The adjustable folding safety cradle or chair of claim 1 or 2, said slats comprising barrel staves.

4. An adjustable folding safety chair, comprising:

(a) a first seat-forming longitudinal section comprising an array of longitudinally extending spaced slats defining continuous spaces therebetween and front and rear sides and first and second opposite ends and further comprising first and second spaced supporting cross members located respectively proximate the first and second opposite ends, thereby defining an uninterrupted intermediate region of continuous slat spaces therebetween;

(b) a second back-forming longitudinal section having front and rear sides and comprising longitudinally extending spaced slats spaced apart for receiving the spaced continuous slats of the first section for sliding movement of said first section along said uninterrupted continuous intermediate region thereof; and (c) the first section forming said seat between the first end thereof and the second section and forming a support leg between the second end thereof and the second section for supporting the chair; and (d) upper and lower spaced transverse bars joined respectively to the rear and front sides of the second section for slidably receiving the first section therebetween and thereby permitting relative pivotal movement of the first and second sections from a first closely adjacent folded position to a second spaced position with the upper rear and lower front cross bars abutting the upper and lower sides of the first section for preventing the first and second sections from being pivoted further apart;

(e) whereby sliding movement of said first section relative to said second section adjusts the length of the seat relative to the leg.

5. The adjustable folding safety chair of claim 4, the slats comprising barrel staves.

* * * * *